US007486235B2

(12) United States Patent
Leeper et al.

(10) Patent No.: US 7,486,235 B2
(45) **Date of Patent: *Feb. 3, 2009**

(54) ANTENNA SYSTEM FOR IMPROVING THE PERFORMANCE OF A SHORT RANGE WIRELESS NETWORK

(75) Inventors: David G. Leeper, Scottsdale, AZ (US); Thomas A. DeMarchi, Mission Viejo, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/379,916

(22) Filed: Apr. 24, 2006

(65) Prior Publication Data

US 2006/0181461 A1 Aug. 17, 2006

Related U.S. Application Data

(63) Continuation of application No. 10/214,679, filed on Aug. 7, 2002, now Pat. No. 7,034,749.

(51) Int. Cl.
*H01Q 1/38* (2006.01)

(52) U.S. Cl. ..... 343/700 MS; 343/754; 343/853; 343/878

(58) Field of Classification Search ..... 343/700, 343/754, 878, 879, 880, 881, 882, 700 MS, 343/853

See application file for complete search history.

(56) References Cited

U.S. PATENT DOCUMENTS 5,552,798 A 9/1996 Dietrich et al.
5,969,689 A 10/1999 Martek et al.
6,160,514 A 12/2000 Judd
6,198,460 B1 3/2001 Brankovic
6,448,930 B1 9/2002 Judd
6,456,242 B1 9/2002 Crawford
6,763,062 B1 7/2004 Kohno et al.
6,782,277 B1 8/2004 Chen et al.
7,034,749 B2 4/2006 Leeper et al.
2001/0016504 A1 * 8/2001 Dam et al. ..... 455/562

FOREIGN PATENT DOCUMENTS

EP 0936693 8/1999

(Continued)

OTHER PUBLICATIONS

Chen, James C., et al., "Measured Performance of 5-GHz 802.11a Wireless LAN Systems", *Atheros Communications, Inc.*, (Aug. 27, 2001),1-11.

Markus, J., et al., *McGraw-Hill Electronics Dictionary*, Fifth Edition, McGraw-Hill, Inc.,(1994),p. 390.

Weik, M. H., *Communications Standard Dictionary*, Van Nostrand Reinhold Company,(1983),p. 678.

(Continued)

*Primary Examiner*—Tho G Phan
(74) *Attorney, Agent, or Firm*—Schwegman, Lundberg & Woessner, P.A.

(57) ABSTRACT

An antenna system for providing network access services to wireless users generates at least a first and a second antenna beam, where the second antenna beam is movable with respect to the first. Additional antenna beams may also be generated. During installation of the antenna system, an installer may adjust the position of the second antenna beam (and possibly other antenna beams) in a manner that enhances the maximum data-rate coverage area of the antenna system for a given deployment region.

19 Claims, 7 Drawing Sheets

FOREIGN PATENT DOCUMENTS

| | | | |
|---|---|---|---|
| EP | 0936693 | A1 | 8/1999 |
| JP | 06-350327 | | 12/1994 |
| JP | 11-298953 | | 10/1999 |
| JP | 2000-068738 | | 3/2000 |
| JP | 2000-216616 | | 8/2000 |
| JP | 2000-332666 | | 11/2000 |
| JP | 2001-136024 | | 5/2001 |
| WO | WO-01/29926 | | 4/2001 |
| WO | WO-02/31908 | | 4/2002 |
| WO | WO-0241450 | A1 | 5/2002 |

OTHER PUBLICATIONS

"International Search Report for corresponding PCT Application No. PCT/US03/23702", (Jan. 13, 2004), 4 pgs.
"Office Action for corresponding PCT Application No. 03784838.9", (Jun. 1, 2006), 5 pgs.
"Written Opinion for corresponding PCT Application No. PCT/US03/23702", (May 4, 2006), 4 pgs.
"First Office Action for corresponding Chinese Patent Application No. 03802253.2", (Mar. 23, 2007), 10 pgs.
"International Preliminary Examination Report for corresponding PCT Application No. PCT/US03/23702", (May 9, 2007), 3 pgs.
"Office Action for corresponding European Patent Application No. 03784838.9", (Mar. 7, 2007), 3 pgs.
"Search Report and Substantive Examination Report for corresponding Malaysian Patent Application No. PI20032743", (Apr. 5, 2007), 4 pgs.
European Application No. 0378483.9 Office Action dated Mar. 7, 2007, 3 pgs.
Japanese Patent Application No. 2004 527670 Office Action mailed Jun. 20, 2007, 7 pgs.
Malaysian Application Serial No. PI 20032743 Substantive Examination Adverse Report dated Jun. 4, 2007, 4 pgs.
"U.S. Appl. No. 10/214,679 Final Office action mailed Apr. 20, 2004", (Apr. 20, 2004), 5 pages.
"U.S. Appl. No. 10/214,679 Non-Final Office action mailed Jan. 25, 2005", (Jan. 25, 2006), 6 pages.
"U.S. Appl. No. 10/214,679 Non-Final Office action mailed Aug. 3, 2005", (Aug. 3, 2005), 15 pages.
"U.S. Appl. No. 10/214,679 Non-Final Office action mailed Aug. 4, 2004", (Aug. 4, 2004), 7 pages.
"U.S. Appl. No. 10/214,679 Non-Final Office action mailed Nov. 7, 2003", (Nov. 7, 2003), 7 pages.
"U.S. Appl. No. 10/214,679 Notice of Allowance mailed Nov. 23, 2005", (Nov. 23, 2005), 8 pages.
"U.S. Appl. No. 10/214,679 Response filed Jan. 7, 2004 to Non-Final Office action mailed Nov. 7, 2003", (Jan. 7, 2004), 10 pages.
"U.S. Appl. No. 10/214,679 Response filed May 25, 2005 to Non-Final Office action mailed Jan. 25, 2005", (May 25, 2005), 15 pages.
"U.S. Appl. No. 10/214,679 Response filed Jul. 19, 2004 to Final Office action mailed Apr. 20, 2004", (Jul. 19, 2004), 11 pages.
"U.S. Appl. No. 10/214,679 response filed Nov. 3, 2005 to Non-Final Office action mailed Aug. 3, 2005", (Nov. 3, 2005), 12 pages.
"U.S. Appl. No. 10/214,679 Response filed Nov. 4, 2004 to Non-Final Office action mailed Aug. 4, 2004", (Nov. 4, 2004), 14 pages.
Chinese Patent Application No. 03802253.2, Response filed Aug. 7, 2007 to Fisrt Office Action mailed Mar. 23, 207 (w/English Translation, 25 pgs.
Japanese Patent Application No. 2004 527670, Notification of Reason(s) for Refusal mailed Feb. 25, 2008 (w/English Translation), 11 pgs.
Malaysian Application Serial No. PI 20032743, Response filed Jul. 4, 2007 to Substantive Examination Report mailed Apr. 5, 2007, 30 pgs.

* cited by examiner

ANTENNA SYSTEM FOR IMPROVING THE PERFORMANCE OF A SHORT RANGE WIRELESS NETWORK

This application is a Continuation of U.S. Ser. No. 10/214,679 filed on Aug. 7, 2002 now U.S. Pat. No. 7,034,749, which is incorporated herein by reference.

BACKGROUND OF THE INVENTION

Short range wireless technologies (e.g., IEEE 802.11a, IEEE 802.11b, Bluetooth®, Ultrawideband, HomeRF, HIPERLAN, etc.) are becoming increasingly popular for providing communication between both fixed and portable devices. Such technologies are capable of providing low power, low-cost, high-bandwidth communication to a variety of users. In one possible application, such technologies may be used to provide wireless communication between a user device and a network access point. The network access point may serve, for example, as a gateway to the Internet or to another large network. Such network access points have traditionally used omni-directional antennas to communicate with surrounding users. Thus, the strength at which signals are received by a user device from the access point drops rapidly with increasing distance from the access point. As the receive signal strength drops off, the data rate that is sustainable over the wireless link decreases accordingly. As a result, maximum data rates are only supportable within a small area about the access point. It is generally desirable that the area of maximum data rate coverage about a wireless access point be as large as practically possible. It is also generally desirable that the area within which maximum data rates are achievable be easily conformable to a region within which the access point is being deployed.

DETAILED DESCRIPTION

Figure 1:
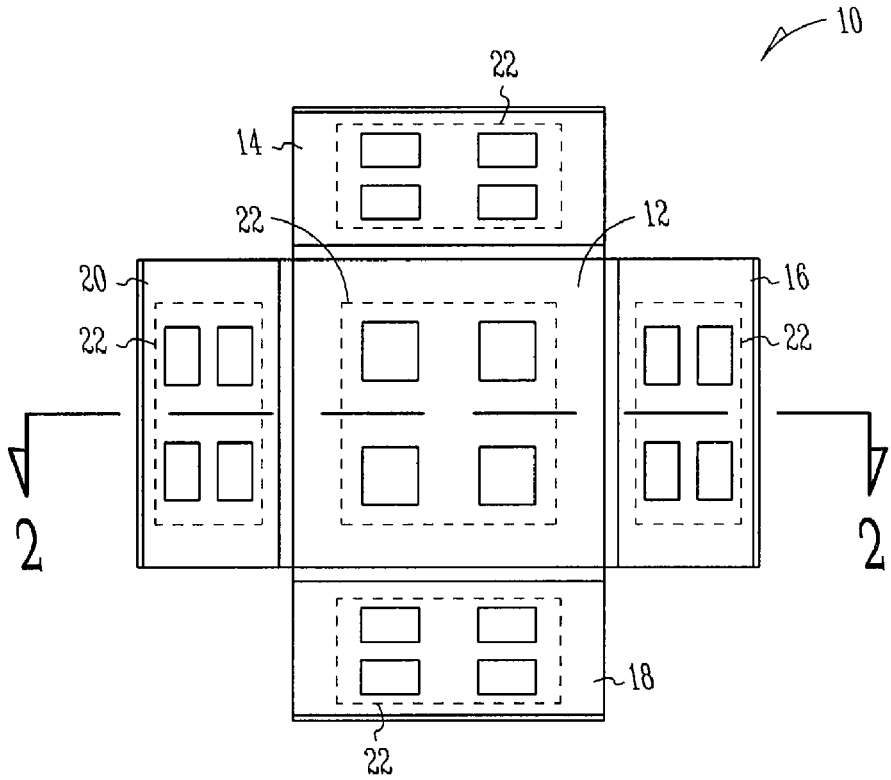
FIG. 1 is a bottom view of an antenna system in accordance with an embodiment of the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Figure 2:
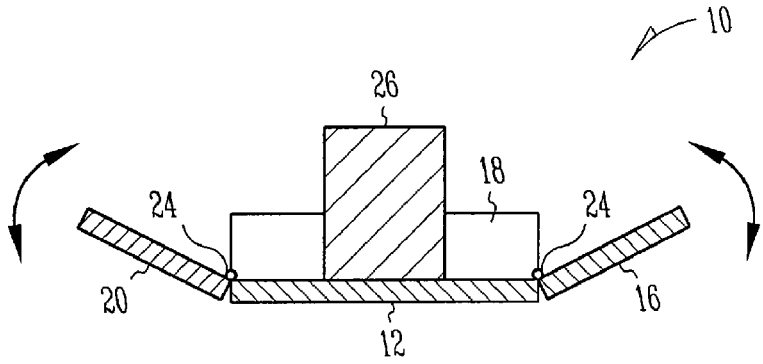
FIG. 2 is a sectional side view of the antenna system of FIG. 1.

FIG. 1 is a bottom view of an antenna system 10 in accordance with an embodiment of the present invention. In at least one application, the antenna system 10 is used to provide short range wireless access point services to users who desire connection to a network. As used herein, the term "short-range" refers to distances of 100 meters or less. As illustrated, the antenna system 10 includes a main panel 12 and four pivotable side panels 14, 16, 18, 20. The main panel 12 and each of the side panels 14, 16, 18, 20 has a corresponding array of antenna elements 22 disposed thereon. Each array of elements 22 is operative for generating a corresponding antenna beam (receive and/or transmit) during system operation. Thus, the antenna system 10 of FIG. 1 will generate 5 main beams during normal operation (side lobes may also be present). FIG. 2 is a sectional side view of the antenna system 10 of FIG. 1 illustrating the connection of the side panels 16, 20 to the main panel 12 using hinges 24. Any form of hinge may be used. As will be described in greater detail, a locking mechanism may also be provided to lock each side panel 14, 16, 18, 20 in a fixed position when the antenna system 10 is eventually installed. The antenna system 10 may also include a mount 26 for use in mounting the system 10 within a deployment region (e.g., a region within which network access services are to be provided). The mount 26 may include any structure or structures capable of facilitating attachment of the antenna system 10 in a desired position in the deployment region. The mount 26 may also provide a conduit for any electrical and/or feed lines that will need to be directed to the antenna system.

When deployed, the antenna system 10 is mounted in an elevated position within the deployment region. This may include, for example, a ceiling mount, a pole mount, a wall mount, or other similar mount locations. During antenna operation, each of the beams generated by the antenna system 10 is directed in a generally downward direction to "illuminate" a corresponding portion of the floor space below. The overall coverage pattern of the antenna system 10 is a combination of the individual footprints of each of these beams. During installation of the antenna system 10, an installer may make adjustments to the antenna system 10, based on the characteristics of the particular deployment region, so that an optimal coverage pattern is obtained for the region. That is, the antenna system 10 may be adjusted in a manner that is designed to maximize the area within which maximum data rates are supportable within the deployment region. To accomplish this, the installer may, for example, adjust and appropriately fix the angular orientation of each of the side panels 14, 16, 18, 20 with respect to the main panel 12.

The angle of the side panels 14, 16, 18, 20 may be adjusted based upon some physical characteristic of the deployment region such as, for example, the distance between the mounted antenna system 10 and the floor below (i.e., the deployment height). When the deployment height of the antenna system 10 is low (e.g., when the antenna system is ceiling mounted and the ceiling height is low), larger side panel angles may be used to broaden the area of maximum data rate coverage. In contrast, when the deployment height is larger, smaller side panel angles may be used to achieve more uniform coverage within the region. In one possible installation technique, an installer may first estimate the deployment height of the antenna system 10 and then adjust and fix the angles of the side panels 14, 16, 18, 20 accordingly. A table may be provided that lists the appropriate side panel angles for different ranges of deployment height. The side panel angles may be adjusted either before or after the antenna system 10 is actually mounted.

Other techniques for adjusting the angles of the side panels 14, 16, 18, 20 during installation may alternatively be used. For example, in one approach, a flat reflective element (e.g., a mirror) is provided on one or more of the side panels of the antenna system 10 for use in adjusting the side panels 14, 16, 18, 20. One installer may then adjust the angle of a side panel while another installer directs, for example, a laser pointing device at the reflective element from a point where the corresponding beam is to be centered. When the laser pointer is reflected directly back upon itself, the angle of the side panel is fixed in place. A similar technique utilizes an installer's eyesight to determine whether proper alignment of the beam has been achieved. That is, one installer may stand at the point where the corresponding beam is to be centered and view the reflective element using an optical device, such as binoculars or a telescope, while another installer adjusts the angle of the corresponding side panel. When the first installer sees his own image in the reflector, he instructs the second installer to fix the side panel in place. An installer may determine the appropriate place to stand during adjustment based on criteria such as, for example, the size and shape of the room, the deployment height, knowledge of antenna beam width, etc.

In at least one implementation, one or more of the antenna arrays 22 associated with the side panels 14, 16, 18, 20 have electronic beam steering capability. That is, phased array techniques are used to provide an additional level of adjustability in the direction of the beam. Phased array techniques may also be used to provide some degree of beam shaping capability. These capabilities may be used by an installer to further improve the maximum data rate coverage pattern within the deployment region (e.g., after the mechanical adjustments have been made). For example, an installer may be able to direct a beam from one of the side panels to the left or right to obtain enhanced coverage in, for example, an odd shaped corner of a room. The installer may also decide to adjust the shape of the antenna beam (e.g., the beamwidth, etc.) to better suit a particular deployment region. To electronically adjust the direction of the main beam associated with a side panel, the excitation phases of the corresponding array elements may be adjusted. To electronically adjust the shape of the main beam, the excitation phases and amplitudes of the corresponding array elements maybe adjusted. An adjustable beamformer network is typically used to provide such functionality. Such beamforming techniques are well known in the art. Once an installer has achieved an optimal beam direction and/or shape for the beam associated with a side panel, the corresponding phase and/or amplitude values are fixed within the associated beamformer and do not change thereafter (unless the antenna system 10 is subsequently moved or a periodic recalibration is performed).

Figure 3:
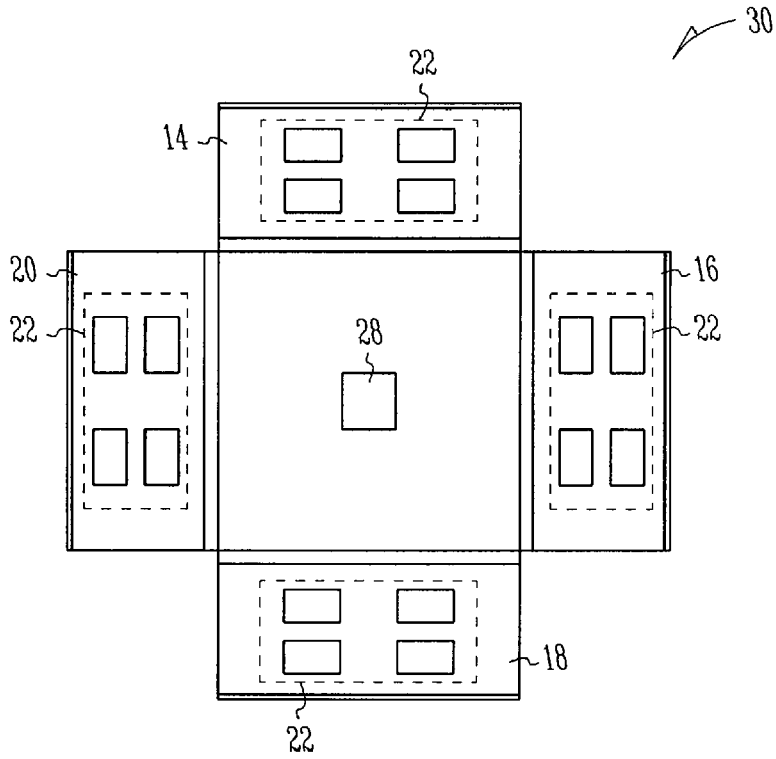
FIG. 3 is a bottom view of an antenna system in accordance with another embodiment of the present invention.

It should be appreciated that the antenna system 10 of FIG. 1 is merely illustrative of certain inventive principles and many modifications can be made thereto. For example, any number of pivotable side panels may be used. In one possible implementation, for example, only a single pivotable side panel is provided. In addition, the side panels and the main panel may assume any shape. For example, in another possible implementation, the main panel 12 has a hexagonal shape and six side panels are provided, one hinged on each edge of the hexagon. As will be appreciated, any number of different configurations can be used. Likewise, the number and configuration of the antenna elements within each array may be varied. In at least one embodiment, as illustrated in FIG. 3, an antenna system 30 is provided that includes a main panel 12 having a single antenna element 28 and side panels 14, 16, 18, 20 that each include an array of elements. It may also be desirable to include only a single element within one or more of the side panels. Any of a wide variety of different antenna element types may be used within an antenna system in accordance with the invention. In one approach, for example, microstrip patch elements are used on each of the panels. Other types of elements that can be used include, for example, dipoles, ground planes, slots, loops, and others, including combinations of the above. Any type of polarization can be used including, for example, linear, circular, elliptical, or cross-polarization.

Figure 4:
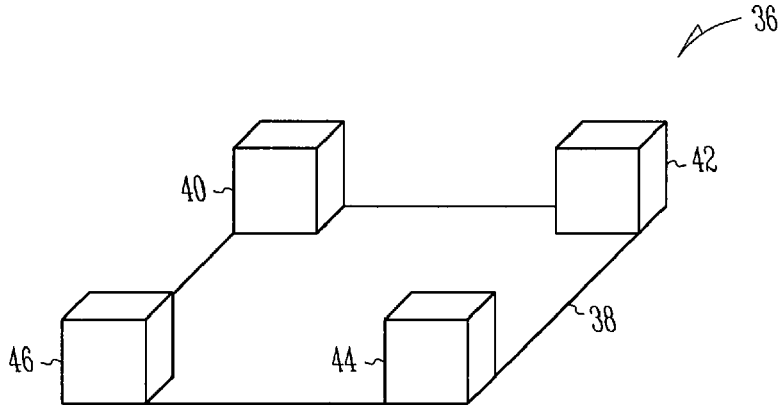
FIG. 4 is a perspective view of a fixture that is used in at least one embodiment of the invention to fix the angle of the side panels of an antenna system.
Figure 5:
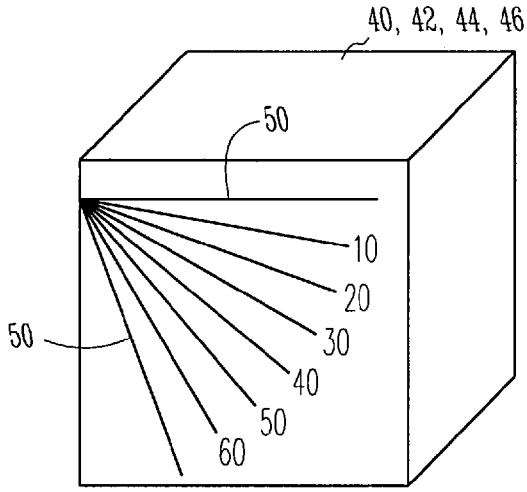
FIG. 5 is a perspective view of a corner block used within the fixture of FIG. 4 in accordance with an embodiment of the present invention.

As described previously, the antenna system 10 of FIG. 1 will typically include one or more locking mechanisms for locking the side panels 14, 16, 18, 20 in place during installation. As will be appreciated, any structure that is capable of locking a pivotable side panel in place may be used. In one approach, for example, the hinges 24 coupling the side panels to the main panel include screws (e.g., with a wingnut) that may be tightened to lock a corresponding panel in place. Clamps, brackets, and other mechanical structures may alternatively be used. FIG. 4 is a perspective view illustrating a fixture 36 that is used in at least one embodiment of the invention to fix the angle of the side panels 14, 16, 18, 20. The fixture 36 includes a base portion 38 having blocks 40, 42, 44, 46 disposed in corresponding cornerss thereof In one approach, the base portion 38 includes a wire frame that holds the corner blocks 40, 42, 44, 46 in position. Planar materials may alternatively be used. The blocks 40, 42, 44, 46 are preferably pyramidal in shape, although other shapes (e.g., square, rectangular, etc.) may alternatively be used. The actual shape of each block will typically depend upon the number and arrangement of the side panels being used. As illustrated in FIG. 5, the blocks 40, 42, 44, 46 may include detents 48, with corresponding angle indications, on appropriate sides thereof for use in setting the angle of the corresponding side panels. Stops 50 may also be provided to set upper and lower limits on the angle of the panels.

Figure 6:
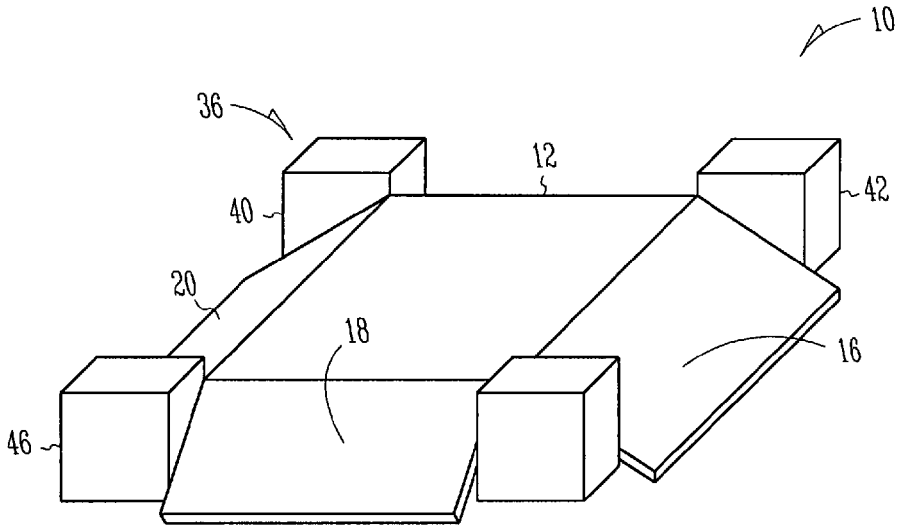
FIG. 6 is a perspective view of the fixture of FIG. 4 with an antenna system inserted therein.

FIG. 6 is a perspective view illustrating the fixture 36 of FIG. 4 with the antenna system 10 of FIG. 1 inserted therein. As shown, each of the side panels 16, 18, 20 of the antenna system 10 are press fit between corresponding pairs of blocks. After the antenna system 10 has been inserted into the fixture 36, the installer may adjust the angle of each of the side panels 14, 16, 18, 20 by moving the panel to the appropriate detent on the corresponding blocks. The panel is thereafter held in place by the compression force of the blocks. The antenna system 10 may then remain within this fixed position throughout its deployment life. In one embodiment, the blocks 40, 42, 44, 46 are formed of a lightweight plastic material, although other materials may alternatively be used. Preferably, the material will be dielectric in nature. In at least one implementation, a radome structure is attached to the blocks 40, 42, 44, 46 of the fixture 36 to cover and protect the antenna system 10 during deployment. The material used to provide the radome will preferably be low loss or transparent to radio frequency (RF) energy in the operational frequency range of the antenna system 10.

Figure 7:
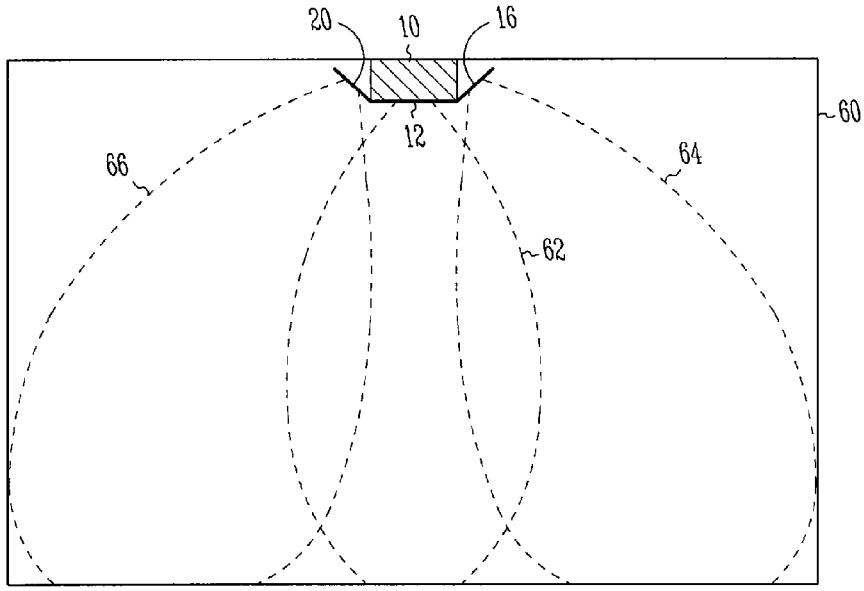
FIG. 7 is a sectional side view of a room having the antenna system of FIG. 1 ceiling-mounted therein and illustrating a possible coverage scenario of the antenna system.
Figure 8:
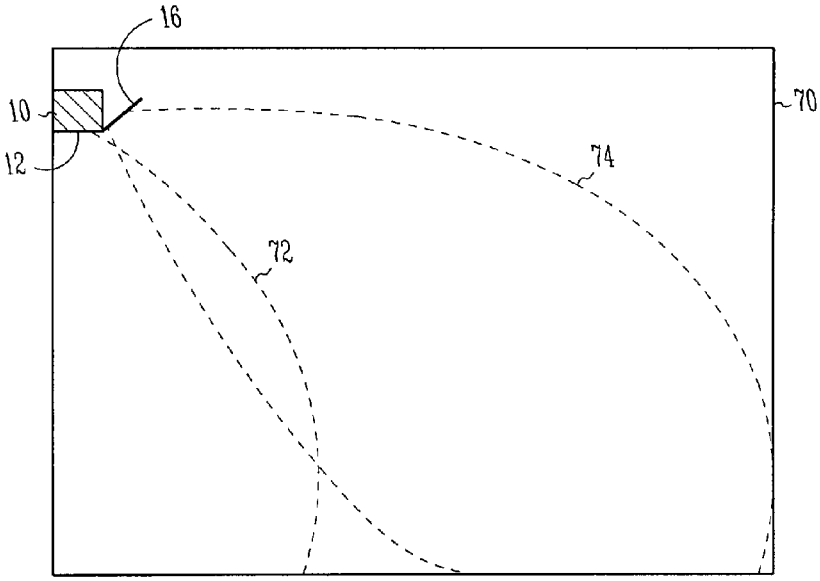
FIG. 8 is a sectional side view of a room having the antenna system of FIG. 1 wall-mounted therein and illustrating a possible coverage scenario of the antenna system.

As discussed above, the antenna system of the present invention will preferably be mounted in an elevated position within a deployment region. The side panel angles may then be adjusted and fixed in a manner that enhances the maximum data rate coverage area within the region. FIG. 7 is a sectional side view of a room 60 having a ceiling-mounted antenna system 10 for use in providing network access services to wireless users within the room 60. As shown, the main panel 12 of the antenna system 10 generates a main beam 62 in a generally downward direction that covers a central portion of the floor space of the room (side lobes may also be generated). Similarly, side panel 16 generates a main beam 64 in a generally downward direction that covers a side portion of the floor space and side panel 20 generates a main beam 66 in a generally downward direction that covers an opposite side portion of the floor space. Similar beams may be generated by the other side panels 14, 18 of the antenna system 10. Because almost the entire floor space is illuminated in a relatively uniform fashion, maximum data rates may be supported throughout the room 60. FIG. 8 illustrates a room 70 having a wall-mounted antenna system 10 that includes a main panel 12 and a single side panel 16. The main panel 12 generates a beam 72 in a generally downward direction that covers a first side portion of the floor space of room 70 and side panel 16 generates a beam 74 in a generally downward direction that covers a second side portion of the floor space of room 70. As will be appreciated, many alternative antenna system deployment scenarios are also possible.

Figure 9:
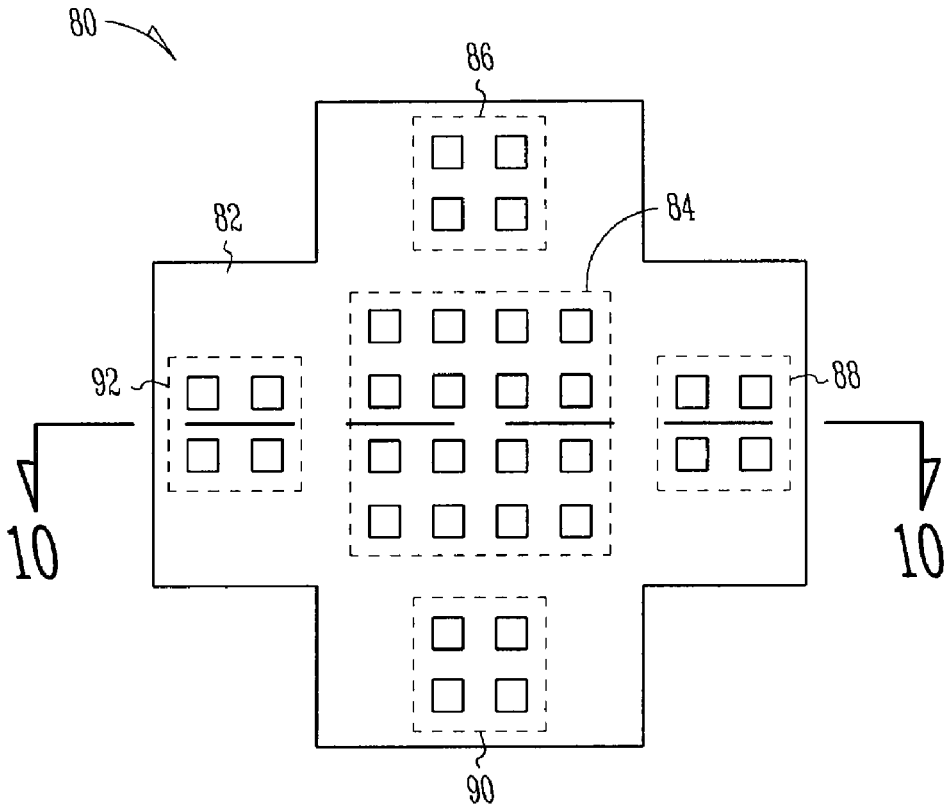
FIG. 9 is a bottom view of an antenna system in accordance with still another embodiment of the present invention.

FIG. 9 is a bottom view of an antenna system 80 in accordance with another embodiment of the present invention. The antenna system 80 includes a single panel 82 having a number of separate antenna arrays 84, 86, 88, 90, 92 disposed thereon. In the illustrated embodiment, the panel 82 includes a main array 84 centrally located on the panel 82 and four side arrays 86, 88, 90, 92 distributed around the main array 84. The number, size, and arrangement of the arrays on the panel 82 and the size and shape of the panel 82 may vary from implementation to implementation. During operation, each of the arrays 84, 86, 88, 90, 92 on the panel 82 generates a corresponding antenna beam (receive and/or transmit). The antenna system 80 maybe electronically adjusted during installation to maximize the area of full data rate coverage within a corresponding deployment region. In one approach, for example, each of the side arrays 86, 88, 90, 92 has an electronically steerable beam that may be adjusted by the installer during the installation process. The installer may, for example, make one or more measurements within the deployment region (e.g., deployment height, room size, distance to walls, etc.) and then set the angles of the individual beams accordingly using phased array techniques. In at least one embodiment, the shapes of one or more of the individual beams may also be adjusted during installation (by, for example, adjusting the excitation amplitude and phase of individual elements within a corresponding array). The beam generated by the main array 84 may or may not be adjustable. In at least one embodiment, a single antenna element is used in place of the main array 84. Separate beamformers maybe provided for each of the arrays 84, 86, 88, 90, 92 on the panel 82. Once an installer has achieved an optimal beam direction and/or shape for the beam associated with one of the arrays 84, 86, 88, 90, 92, the corresponding phase and/or amplitude values are fixed within the associated beamformer and do not change thereafter (unless the antenna system 80 is subsequently moved or a periodic recalibration is performed).

Figure 10:
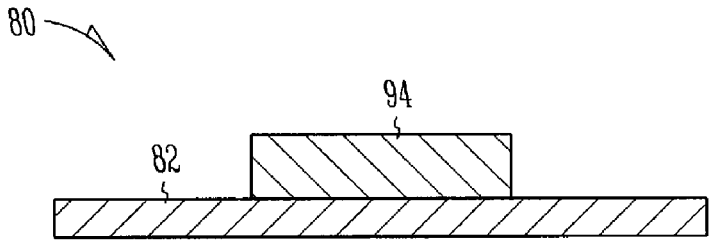
FIG. 10 is a sectional side view of the antenna system of FIG. 9.

FIG. 10 is a sectional side view of the antenna system 80 of FIG. 9. As shown, the antenna system 80 may include an optional mount 94 coupled to the panel 82 for use in mounting the system 80 within the deployment region. The mount may include any structure or structures capable of facilitating attachment of the antenna system 80 in an elevated position in the deployment region.

Figure 11:
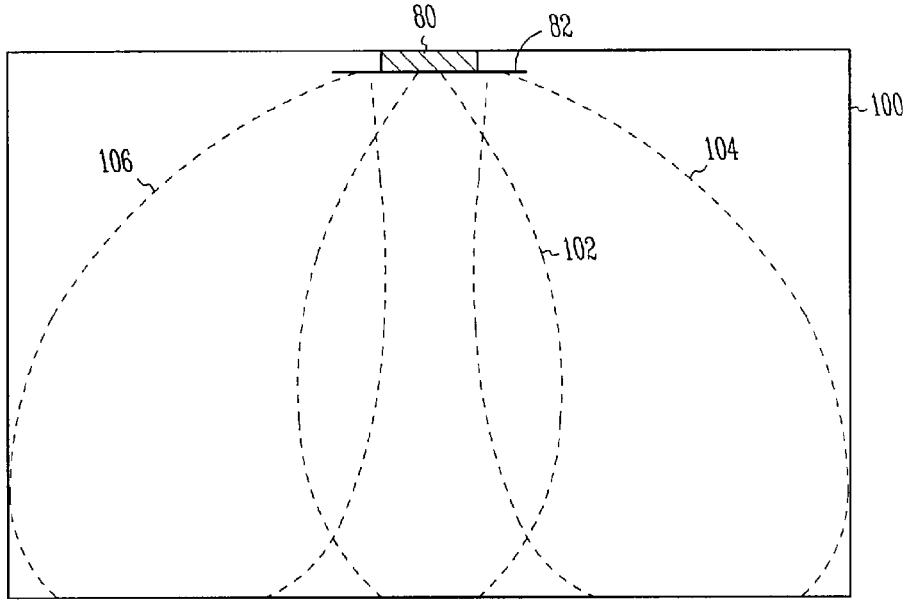
FIG. 11 is a sectional side view of a room having the antenna system of FIG. 9 ceiling-mounted therein and illustrating a possible coverage scenario of the antenna system.
Figure 12:
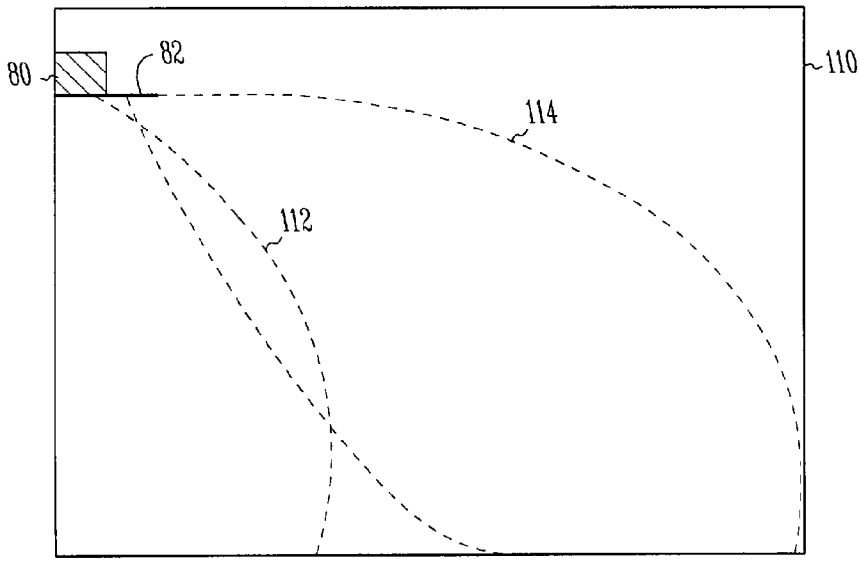
FIG. 12 is a sectional side view of a room having the antenna system of FIG. 9 wall-mounted therein and illustrating a possible coverage scenario of the antenna system.

FIG. 11 is a sectional side view of a room 100 having a ceiling-mounted antenna system 80 for use in providing network access services to wireless users within the room 100. As shown, the panel 82 of the antenna system 80 generates a main beam 102 in a generally downward direction that covers a central portion of the floor space of the room 100. Similarly, one side array on the panel 82 generates a beam 104 that covers a side portion of the floor space and another side array generates a beam 106 that covers an opposite side portion of the floor space. Similar beams may be generated by the other side arrays on the panel 82. Because almost the entire floor space is illuminated in a relatively uniform fashion, maximum data rates may be supported throughout the room 100. FIG. 12 illustrates a room 110 having a wall-mounted antenna system 80. The main antenna array on the panel 82 generates a beam 112 that covers a first side portion of the floor space of room 110 and a side array on the panel 82 generates a beam 114 that covers a second side portion of the floor space of room 110. As will be appreciated, many alternative antenna system deployment scenarios are also possible.

Figure 13:
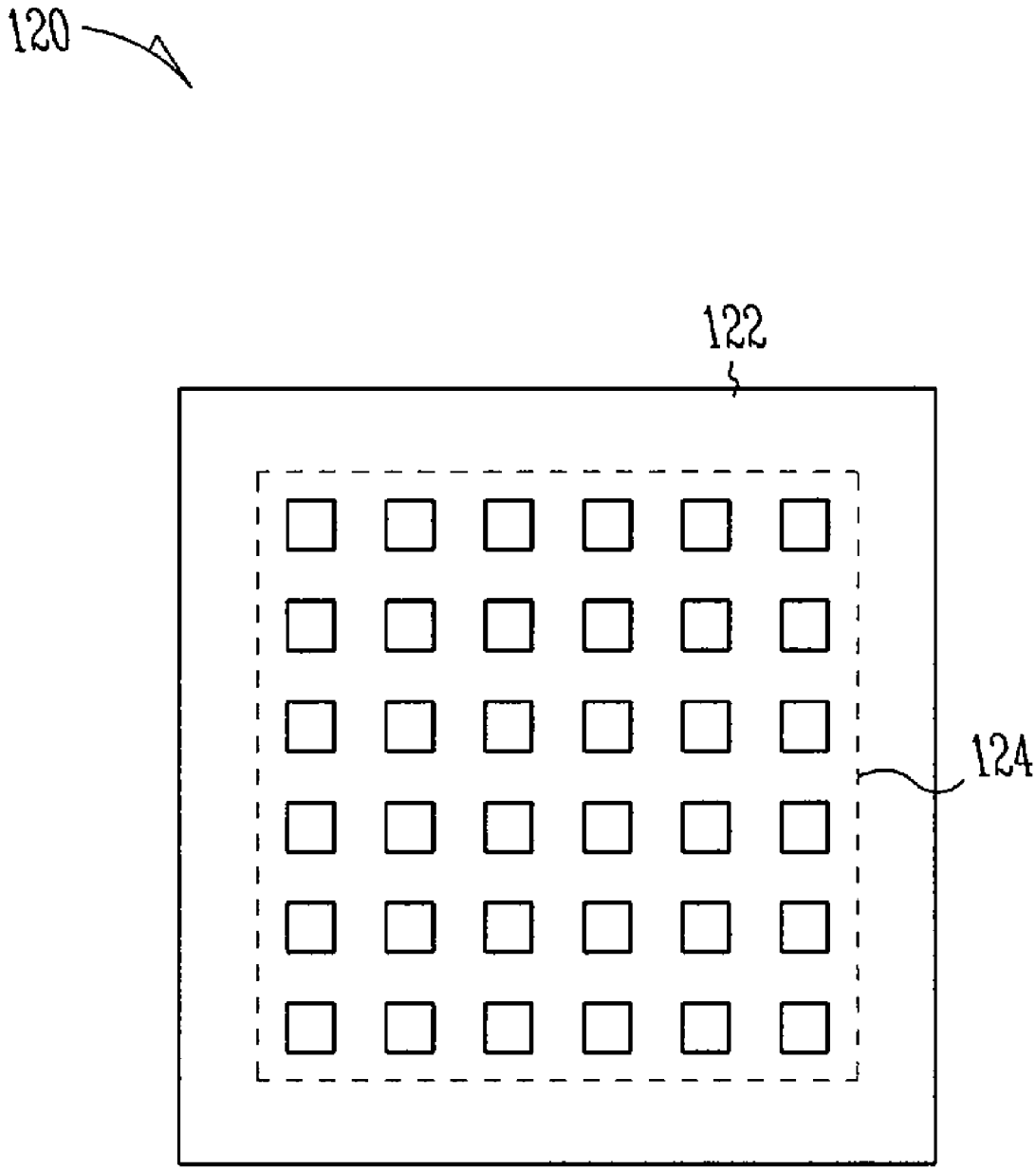
FIG. 13 is a bottom view of an antenna system in accordance with yet another embodiment of the present invention.

FIG. 13 is a bottom view of an antenna system 120 in accordance with yet another embodiment of the present invention. The antenna system 120 includes a single panel 122 having an array 124 of antenna elements disposed thereon. The number and type of elements within the array 124 and the size and shape of the panel 122 may vary from implementation to implementation. During operation, the array 124 generates multiple simultaneous antenna beams (receive and/or transmit) within a deployment region. A multiple-beam beamforming network is used in conjunction with the array 124 to generate the multiple antenna beams. The multiple-beam beamforming network will typically be co-located with the antenna system 120. Such beam forming structures are well known in the art. In one implementation, one or more of the beams generated by the array 124 are electronically steerable to allow an installer to adjust the beam(s) in a manner that enhances the maximum data rate coverage area of the system 120 within the deployment region. After optimal beam positions have been achieved for a particular deployment region, the beamformer settings are fixed and the beams remain stationary thereafter.

Although the present invention has been described in conjunction with certain embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. An antenna system for use in providing short-range wireless access to a network, comprising:

a panel having at least one first antenna element to generate a first antenna beam and an array of second antenna elements to generate a second antenna beam, wherein said second antenna beam is electronically steerable with respect to said first antenna beam using phased array techniques;

a mount, coupled to said panel, to mount said antenna system in an elevated position within a network access deployment region so that said first antenna beam and said second antenna beam are directed in a generally downward direction within the network access deployment region;

an adjustable beamformer network to adjust excitation phases and amplitudes of the array of second antenna elements to electronically adjust a shape of the second antenna beam and to adjust excitation phases of the array of second antenna elements to electronically adjust a direction of the second antenna beam; and wherein said panel further includes at least one additional array of antenna elements to generate at least one additional antenna beam, wherein said at least one additional antenna beam is electronically steerable with respect to said first and second antenna beams.

2. The antenna system of claim 1, wherein:

said mount includes a ceiling mount.

3. The antenna system of claim 2 wherein the array of antenna elements and the array of second antenna elements each comprise microstrip patch elements, dipoles, ground planes, slots, or loops, or combinations of microstrip patch elements, dipoles, ground planes, slots, and loops with linear, circular, elliptical, or cross-polarization.

4. The antenna system of claim 1, wherein:

said mount includes a wall mount.

5. An antenna system for use in providing short-range wireless access to a network, comprising:

a panel having at least one first antenna element to generate a first antenna beam and an array of second antenna elements to generate a second antenna beam, wherein said second antenna beam is electronically steerable with respect to said first antenna beam using phased array techniques, said at least one first antenna element including an array of antenna elements;

a mount, coupled to said panel, to mount said antenna system in an elevated position within a network access deployment region so that said first antenna beam and said second antenna beam are directed in a generally downward direction within the network access deployment region; and an adjustable beamformer network to adjust excitation phases and amplitudes of the additional array of antenna elements to electronically adjust a shape of the additional antenna beam and to adjust excitation phases of the additional array of antenna elements to electronically adjust a direction of the additional antenna beam.

6. A method comprising:

generating a main antenna beam from a main panel having at least one antenna element disposed thereon;

simultaneously generating at least four side antenna beams respectively from at least four side panels, each side panel being pivotably coupled to said main panel and having at least one antenna element disposed thereon;

directing said main antenna beam and said side antenna beams in a generally downward direction to provide short-range wireless access to a network; and wherein simultaneously generating at least four side antenna beams includes simultaneously generating six side antenna beams respectively from six side panels, each side panel being pivotably coupled to one side of said main panel, said main panel having a hexagonal shane with six sides.

7. The method of claim 6, further comprising electronically steering at least one of said main antenna beam and side antenna beams with a multiple-beam beamformer matrix.

8. The method of claim 6, further comprising adjusting a shape of at least one of the main antenna beam and side antenna beams by adjusting an excitation phase and amplitude of at least one of the antenna elements with a multiple-beam beamformer matrix.

9. The method of claim 6, further comprising adjusting a direction of at least one of the main antenna beam and side antenna beams by adjusting an excitation phase of at least one of the antenna elements with a multiple-beam beamformer matrix.

10. The method of claim 6, wherein:

generating a main antenna beam includes generating said main antenna beam from an array of microstrip patch elements, dipoles, ground planes, slots, or loops, or combinations of microstrip patch elements, dipoles, ground planes, slots, and loops with linear, circular, elliptical, or cross-polarization disposed on said main panel; and simultaneously generating at least four side antenna beams includes generating each side antenna beam from an array of microstrip patch elements, dipoles, ground planes, slots, or loops, or combinations of microstrip patch elements, dipoles, ground planes, slots, and loops with linear, circular, elliptical, or cross-polarization disposed on a respective one of said side panels.

11. An antenna system for use in providing short-range wireless access to a network, comprising:

a main panel having at least one antenna element disposed thereon to generate a main antenna beam;

at least four side panels, each side panel being pivotably coupled to said main panel and having at least one antenna element disposed thereon to generate an antenna beam; and wherein:

said main panel has a hexagonal shape with six sides; and said side panels include six side panels, each side panel being pivotably coupled to one of said sides of said main panel.

12. The antenna system of claim 11 wherein:

said main panel includes a first surface and an opposite second surface wherein said at least one antenna element is disposed on the first surface; and each side panel is adapted to pivot so as to form an obtuse angle between the side panel and the second surface of the main panel.

13. The antenna system of claim 12, further comprising:

a mount, coupled to the second surface of the main panel, to mount said antenna system in an elevated position within a network access deployment region so that each of the antenna beams are directed in a generally downward direction within the network access deployment region.

14. The antenna system of claim 13 wherein:

said mount includes a ceiling mount.

15. The antenna system of claim 13 wherein:

said mount includes a wall mount.

16. The antenna system of claim 11 wherein:

said main panel includes an array of antenna elements to generate said main antenna beam.

17. The antenna system of claim 11 wherein:

each side panel includes an array of antenna elements to generate said antenna beam from said side panel.

18. The antenna system of claim 11, further comprising:

a locking mechanism to lock each of said side panels in a fixed angular position with respect to said main panel.

19. An antenna system for use in providing short-range wireless access to a network, comprising:

a main panel having at least one antenna element disposed thereon to generate a main antenna beam;

at least four side panels, each side panel being pivotably coupled to said main panel and having at least one antenna element disposed thereon to generate an antenna beam; and wherein:

each side panel is connected to said main panel with a hinge;

the antenna element disposed on the main panel and the side panels each includes microstrip patch elements, dipoles, ground planes, slots, or loops, or combinations of microstrip patch elements, dipoles, ground planes, slots, and loops with linear, circular, elliptical, or cross-polarization; and further comprising an adjustable beamformer network to adjust excitation phases and amplitudes of the antenna elements to electronically adjust a shape of each of the main antenna beam and the antenna beams from the side panels and to adjust excitation phases of the antenna elements to electronically adjust a direction of each of the main antenna beam and the antenna beams from the side panels.

* * * * *

UNITED STATES PATENT AND TRADEMARK OFFICE

CERTIFICATE OF CORRECTION

PATENT NO. : 7,486,235 B2
APPLICATION NO. : 11/379916
DATED : February 3, 2009
INVENTOR(S) : Leeper et al.

It is certified that error appears in the above-identified patent and that said Letters Patent is hereby corrected as shown below:

In column 8, line 6, in Claim 6, delete “shane” and insert -- shape --, therefor.

Signed and Sealed this

Twenty-first Day of July, 2009

John Doll

JOHN DOLL
*Acting Director of the United States Patent and Trademark Office*